US005234784A

United States Patent [19]

Aslam et al.

[11] Patent Number: 5,234,784

[45] Date of Patent: Aug. 10, 1993

[54] METHOD OF MAKING A PROJECTION VIEWABLE TRANSPARENCY COMPRISING AN ELECTROSTATOGRAPHIC TONER IMAGE

[75] Inventors: Muhammed Aslam, Rochester; William Light, Victor, both of N.Y.

[73] Assignee: Eastman Kodak Company, Rochester, N.Y.

[21] Appl. No.: 862,652

[22] Filed: Apr. 1, 1992

[51] Int. Cl.[5] ..... G03G 13/01; G03G 13/20

[52] U.S. Cl. ..... 430/45; 430/99; 430/111; 430/124

[58] Field of Search ..... 430/45, 99, 111, 124

[56] References Cited

U.S. PATENT DOCUMENTS

| | | | |
|---|---|---|---|
| 4,791,447 | 12/1988 | Jacobs | 430/124 |
| 4,913,991 | 4/1990 | Chiba et al. | 430/45 |
| 4,931,618 | 6/1990 | Nagata et al. | 219/216 |
| 5,089,363 | 2/1992 | Rimai et al. | 430/45 |
| 5,110,704 | 5/1992 | Inoue et al. | 430/111 X |
| 5,118,589 | 6/1992 | Aslam et al. | 430/99 X |
| 5,126,221 | 6/1992 | Chiba et al. | 430/45 |

FOREIGN PATENT DOCUMENTS 63-300254 12/1988 Japan .

*Primary Examiner*—Roland Martin

*Attorney, Agent, or Firm*—Nixon, Hargrave, Devans & Doyle

[57] ABSTRACT

A method of fusing an electrostatographic colored toner image on a transparent support to provide a projection viewable color transparency exhibiting excellent color clarity. The support comprises a polymer layer bearing the color toner image. The toner image and the polymer forming the layer on the support have a loss tangent value of at least 1.6. The transparent element is subjected to fusing in three distinct zones; a fusing zone where it is contacted with a textured fusing member, a cooling zone where contact with the fusing member is maintained and the toner image is cooled and a release zone where the toner image is released from the fusing member at a temperature where no toner image or polymer layer offset occurs.

14 Claims, 1 Drawing Sheet

METHOD OF MAKING A PROJECTION VIEWABLE TRANSPARENCY COMPRISING AN ELECTROSTATOGRAPHIC TONER IMAGE

FIELD OF THE INVENTION

This invention relates to a method of fusing an electrostatographic toner image on a transparent support comprising a polymer layer bearing such image. In one aspect, this invention pertains to such method for providing a projection viewable transparency wherein the unfused toner image and the polymer layer exhibit specific viscoelastic properties and the unfused toner image is converted to a fused image in three zones or stages while it is in contact with a fusing member having a textured surface. More particularly, this invention relates to such a fusing method for making a transparency capable of projecting an electrostatographic colored toner image exhibiting excellent color clarity.

BACKGROUND

In electrostatography an image comprising an electrostatic field pattern, usually of non-uniform strength, (also referred to as an electrostatic latent image) is formed on an insulative surface of an electrostatographic element by any of various methods. For example, the electrostatic latent image may be formed electrophotographically (i.e., by imagewise photo-induced dissipation of the strength of portions of an electrostatic field of uniform strength previously formed on a surface of an electrophotographic element comprising a photoconductive layer and an electrically conductive substrate), or it may be formed by dielectric recording (i.e., by direct electrical formation of an electrostatic field pattern on a surface of a dielectric material). Typically, the electrostatic latent image is then developed into an electrostatographic toner image by contacting the latent image with an electrostatographic developer containing an electrostatographic toner. If desired, the latent image can be transferred to another surface before such development. Although such techniques are typically used for black and white reproductions such as copying business correspondence, they are capable of forming a variety of single color or multicolor toner images.

A typical method of making a multicolor copy involves trichromatic color synthesis by subtractive color formation. In such synthesis successive latent electrostatic images are formed on a substrate, each representing a different color, and each image is developed with a toner of a different color and is transferred to a support (receiver). Typically, but not necessarily, the images will correspond to each of the three primary subtractive colors (cyan, magenta and yellow), and black as a fourth color, if desired. For example, light reflected from a color photograph to be copied can be passed through a filter before impinging on a charged photoconductive layer so that the latent electrostatic image on the photoconductive layer corresponds to the presence of yellow in the photograph. That latent image can be developed with a yellow toner and the developed image can be transferred to a support. Light reflected from the photograph can then be passed through another filter to form a latent electrostatic image on the photoconductive layer which corresponds to the presence of magenta in the photograph, and that latent image can then be developed with a magenta toner and transferred to the same support. The process can be repeated for cyan (and black, if desired).

In the systems described previously herein, the toner images may be provided on a support such as paper, film, plastic or glass to which they are permanently fixed. A common technique for fixing such toner images to a support involves employing thermoplastic polymeric toner particles which include a colorant and fusing the particles to the support by the application of heat and pressure thereto. A suitable method involves passing the support with the toner particles thereon through a pair of opposed rolls, one a heated fuser roll and the other a non-heated or heated backup roll.

It is known to use the electrostatographic processes described, to provide transparencies that are primarily intended for viewing by transmitted light, for example, observing a projected image from an overhead projector. In a typical application the viewable fused toner image is either a single color or multicolor image but such viewable image may also have a single color portion and a multicolor portion. An acceptable transparency requires that the colored toner image exhibit good color clarity or chroma. Color clarity or chroma are terms used to describe the quality of an image projected by a transparency and high color clarity or high chroma refers to a faithful reproduction of the original colored image while low color clarity or low chroma refers to less than faithful or inaccurate reproduction of the original colored image. Low color clarity or chroma can result from light scattering or multiple reflections within a colored toner image which in turn results in a color shift upon projection of the color transparency and a failure to faithfully reproduce the colors of the original image. For example, bright yellow in an original image may appear as a muddy yellow.

It is also known that a transparency comprising a colored toner image exhibiting acceptable color clarity can be prepared in a fusing method where the image is pressure contacted with a highly polished heated roll. Such methods also provide toner images that have very high gloss since the toner image surface is smooth and highly reflecting. Unfortunately, toner images having such high gloss are not always desirable. For example, in a reflection color copy comprising a colored toner image it is often desirable to provide a toner image surface that has a low-level luster or fine matte appearance which has been found to be pleasing to a viewer. Such a surface has been achieved by contact fusing colored toner images using fusing surfaces that are textured. For example, textured fusing rolls. Unfortunately, the resultant textured toner image surfaces are known to deleteriously affect color clarity in a color transparency since they exhibit the harmful light scattering or multiple reflections described previously herein.

U.S. Pat. No. 4,791,447 issued Dec. 13, 1988, addresses the problem of providing glossy opaque toner images and high chroma transparencies using a fusing system comprising three roll members which cooperate to form a pair of roll nips.

In light of the previous discussion, it is obvious that it would be desirable to have a fusing method that is sufficiently flexible to provide transparencies comprising color toners having high color clarity and also be capable of providing toner images that exhibit the pleasing low-level luster that is desired in certain reflection copy prints such as continuous tone reflection copy prints. This invention provides such a fusing method.

SUMMARY OF THE INVENTION

In accordance with this invention, a transparency capable of projecting an electrostatographic colored toner image that exhibits excellent color clarity is obtained in a method which comprises (a) providing an element having a transparent support comprising a polymer layer bearing an image in colored toner particles that exhibit a loss tangent (tan δ) of at least 1.6 upon fusing the image with heat and pressure, the polymer forming such layer also having a loss tangent of at least 1.6, (b) passing the element successively through a fusing zone, a cooling zone and a release zone, (c) within the fusing zone, bringing the image and polymer layer into pressure contact with a textured surface of a fusing member at a temperature that fuses the image to the support and causes the polymer layer to flow, the textured surface being capable of providing a low-level luster fused toner image, (d) maintaining contact between the fused image and the fusing member within the cooling zone while reducing the temperature of the fusing member, and (e) separating the fused image from the fusing member within the release zone at a temperature where the toner image and the polymer layer do not offset. The aforementioned loss tangent (tan δ) values describe the rheological characteristics or viscoelasticity of a polymeric material, as will be discussed in detail hereinafter.

The method of this invention provides a technique for separating the contact fusing and fusing member release events that occur during the process by a substantial cooling phase. This is a significant distinction from roll fusing processes of the type employed in U.S. Pat. No. 4,791,447, referred to previously, where such events take place substantially simultaneously. Separating the contact fusing and fusing member release events according to the process of this invention makes it possible to use a fusing temperature which causes the toner particles and the polymer layer on the support to flow sufficiently to acquire a texture from the fusing member and to adhere the fused toner image to the support. The fused image and polymer layer can then be separated from the fusing member after cooling when they do not offset onto the fusing member. Accordingly, the process of this invention is much more easily controlled and represents an obvious advantage over roll fusing techniques of the type described in U.S. Pat. No. 4,791,447. Other advantages of this invention will be described or become obvious from the following description.

DETAILED DESCRIPTION OF THE INVENTION

The unfixed or unfused colored toner image that is fused in the method of this invention can be generated using any electrostatographic image-forming process that forms a toner image comprising discrete toner particles having the loss tangent of at least 1.6 referred to previously herein. Such toner images can comprise line copy, continuous tone images and half-tone images as well as combinations thereof. The toner images are conveniently generated using electrostatographic processes of the type described previously, including the toner images comprising four-color images prepared using digital four-color, full-color printers. Suitable color toner images that can be fused in the method of this invention are described in U.S. Pat. No. 4,913,991, issued Apr. 3, 1990 and Japanese laid-open Application No. 88/300,254, published Dec. 7, 1988.

Figure 1:
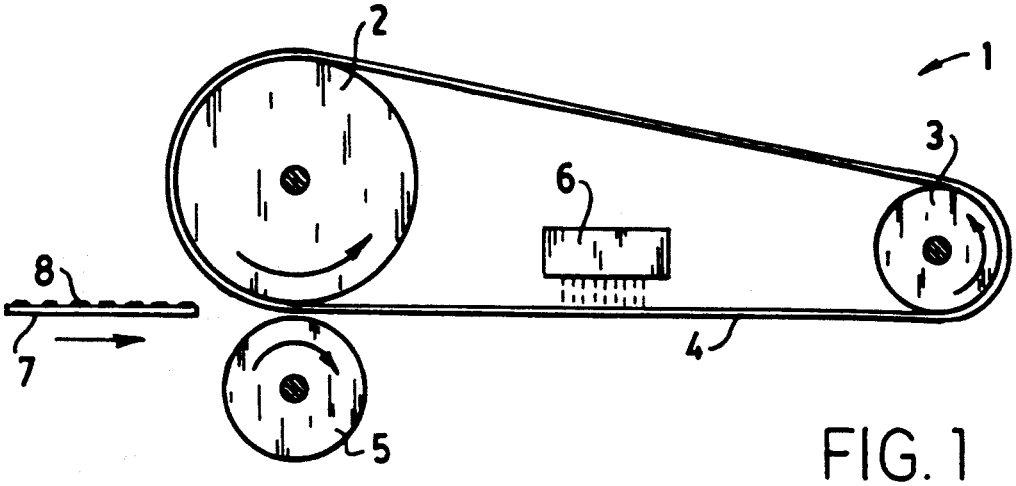
FIG. 1 is a schematic illustration of apparatus suitable for carrying out the method of this invention.

FIG. 1 illustrates preferred apparatus suitable for fusing or fixing an electrostatographic colored toner image to provide a transparency having high color clarity according to the method of this invention. FIG. 1 depicts a fusing device 1 which comprises a heating roll 2, a roll 3 spaced from the heating roll 2, a fusing member which has a textured surface and is trained about heating roll 2 and roll 3 as an endless or continuous web or belt 4 which is conveyed in a counterclockwise direction, as viewed in FIG. 1, upon rotation of the heating roll 2 and roll 3. Backup or pressure roll 5 is biased against the heating roll 2 and the continuous belt 4 is cooled by impinging air provided by blower 6 disposed above the belt 4. In operation, transparent support 7 comprising a polymer layer having a loss tangent of at least 1.6 bearing the unfused colored toner particles also having a loss tangent of at least 1.6 is transported in the direction of the arrow into the nip between heating roll 2 and backup or pressure roll 5 which can be heated if desired, where it enters a fusing zone extending about 2.5 cm laterally along continuous belt 4. Following fusing in the fusing zone, the fused image then continues along the path of the belt 4 and into the cooling zone (about 5 to 25 cm in length) in the region following the nip between heating roll 2 and pressure roll 3. Upon exiting the fusing zone, belt 4 is cooled slightly upon separation from heating roll 3 and then additionally cooled in a controlled manner by air that is caused to impinge upon belt 4 by blower 6. The fused toner image on support 7 then exits the cooling zone and separates from belt 4 as the belt passes around roll 3 and is transported to copy collection means such as a tray (not shown). Support 7 bearing the fused image is separated from the fusing member within the release zone at a temperature where no toner image offset occurs. Separation is expedited by using a roll 3 of relatively small diameter, e.g. a diameter of about 2.5 to 4 cm. After passing through the three distinct zones, i.e. the fusing zone, cooling zone and release zone, the fused colored toner image exhibits high color clarity and is textured. The extent of each of the three zones and the duration of time the toner image resides in each zone can be conveniently controlled simply by adjusting the velocity or speed of belt 4. The velocity of the belt in a specific situation will depend upon several variables, including, for example, the temperature of the belt in the fusing zone, the temperature of the cooling air and the composition of the colored toner particles. U.S. Pat. No. 3,931,618, issued Jun. 5, 1990, describes an image glazing device that is used to apply a gloss to a fused toner image or a dye image. Such device has several features in common with the fusing apparatus depicted in FIG. 1 which features are described in detail in the patent. Accordingly, U.S. Pat. No. 3,931,618 is hereby incorporated by reference herein.

Figure 2:
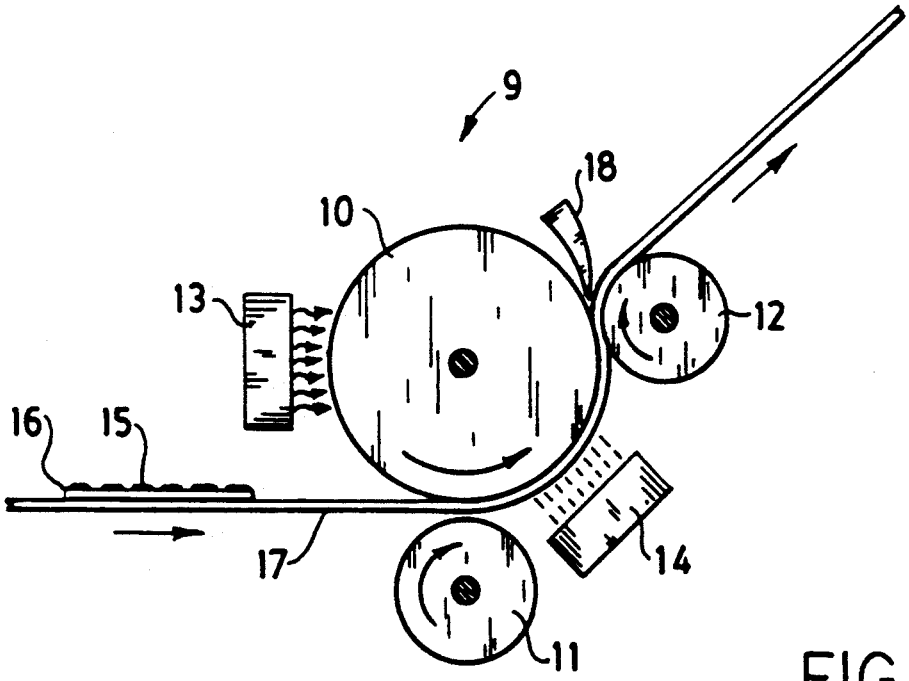
FIG. 2 is a schematic illustration of other apparatus suitable for carrying out the method of this invention.

FIG. 2 illustrates another device suitable for fusing an electrostatographic colored toner image on a transparent support to provide a projection viewable transparency having excellent color clarity. In this device the fusing member is a roll having a textured surface rather than the continuous web shown in FIG. 1. As shown in FIG. 2, the fusing device 9 comprises a roll 10 having a textured surface, forming a nip with backup or pressure roll 11 and another nip with roll 12 and continuous conveyor means 17 trained partly about rolls 10 and 12 and scive 18. Roll 10 rotates in a counterclockwise direction while rolls 11 and 12 rotate in a clockwise direction, as viewed in FIG. 2. The surface of roll 10 is heated by radiant heat from a heater 13 and is cooled by air provided by blower 14. Transparent support 16 comprises a polymer layer which bears unfused colored toner image 15. In operation, support 16 bearing unfixed or unfused toner image 15 is conveyed in the direction of the arrow on continuous conveyor means 17 through the nip between rolls 10 and 11 around roll 10 and continues through the nip between rolls 10 and 12. The toner image passes through the fusing zone extending through the nip between rolls 10 and 11 and proceeds through the cooling zone where blower 14 impinges cold air upon conveyor 17 which cools support 16 bearing fused colored toner image and the surface of roll 10. Upon exiting the cooling zone support 16 bearing the fused colored toner image is separated by scive 18 from roll 10 (now in a cooled condition) after exiting the nip between roll 10 and roll 12. Upon separation support 16 bearing the fused colored toner image is transported by copy handling means to copy collection means such as a tray (not shown). The fused colored toner image is separated from the cooled surface of roll 10 at a temperature where no toner image offset occurs.

It is essential to this invention that the colored toner image fused in the inventive method comprise toner particles that exhibit a loss tangent of at least 1.6, typically about 1.6 to 8.5 and often about 1.6 to 5.5 and the polymer layer bearing such image also have a loss tangent of at least 1.6, typically about 1.6 to 8.5 and often about 1.6 to 5.5. As discussed in Japanese laid-open Application No. 88/300,254, and in U.S. Pat. No. 4,913,991, both referred to hereinbefore, loss tangent describes the rheological characteristics (viscoelasticity) of a toner and is the ratio of the loss modulus (G''). This relationship can be described by the following equation:

$$\tan \delta = \frac{\text{loss modulus}(G')}{\text{storage modulus}(G'')}$$

The rheological characteristics of the toner particles and the polymer forming the surface of the support used in this invention from which such loss tangent can be determined, can be measured using conventional equipment, for example, a rheometer. An example of a suitable rheometer is a Rheometrics Model RDA 700 (commercially available from Rheometrics, Inc., Piscataway, N.J.). Another example is the Rheometrics Dynamic Spectrometer RDS-7700 made by Rheometrics, Inc., which is mentioned in Japanese laid-open Application Number 88/300,254 and U.S. Pat. No. 4,913,991. The rheological characteristics of the toners and layer-forming polymers used in this invention were measured with the Rheometrics Model RDA using parallel plates in a sinusoidal shear mode. Measurements were made at temperatures ranging from 100° to 250° C. and at frequencies ranging from 0.1 to 100 rad./sec. The loss tangent values referred to in this specification and claims were determined for a storage (G') modulus of 10 dynes/cm$^2$ and, therefore, can be directly compared to the loss tangent values reported in Japanese laid-open Application Number 88/300,254 and U.S. Pat. No. 4,913,991.

The aforementioned loss tangents are largely determined by the toner binder polymer or the layer-forming polymer which is the principle determinant of viscoelastic properties. As understood by those skilled in the art, and as illustrated by the following Examples, Japanese laid-open Application Number 88/300,254 and U.S. Pat. No. 4,913,991; the loss tangent of a given polymer material depends upon several variables, including polymer architecture (chain-branching, cross linking or lack thereof) molecular weight distribution, glass transition temperature and additives. Accordingly, the toner particles are formulated with the type of polymer polymer or combination of such polymers which meet the criteria needed to provide a desired loss tangent. Suitable toner polymer materials having the low loss tangent values can conprise an additive which adjusts the loss tangent of a polymer to less than 1.2. Such additives can be used in concentrations up to 50 weight percent of the toner polymer material, and include vinyl addition and/or polycondensation polymers that are high molecular weight and can be highly cross-linked. Such additive polymers frequently have $T_g$ values in the range of about 65° to 125° C. polymeric beads, e.g. polymethylmethacrylate beads can be employed as useful additives. According, the toner particles and layers bearing such particles must be formulated with the type of polymer or combination of such polymers which meet the criteria needed to provide a desired loss tangent. A wide variety of polymer materials can be employed in the colored toner and polymer layers bearing such toner, including vinyl addition polymers and condensation polymers. Such polymers are chosen for their loss tangent values as well as good combinations of advantageous properties, such as toughness, transparency, and adequate adhesion to substrates. Vinyl addition polymers that are useful can be linear, branched or lightly cross-linked. The most widely used condensation polymers are polyesters which are polymers in which backbone recurring units are connected by ester linkages. Like the vinyl addition polymers, polyesters useful as binder materials in toner particles and as layer-forming polymers can be linear, branched or lightly cross-linked. They can be fashioned from any of many different monomers, typically by polycondensation of monomers containing two or more carboxylic acid groups (or derivatives thereof, such as anhydride or ester groups) with monomers containing two or more hydroxy groups. Specific examples of useful binder polymers include olefin homopolymers and copolymers, such as polyethylene, polypropylene, polyisobutylene, and polyisopentylene; polyfluoroolefins such as polytetrafluorethylene; polyhexamethylene adipamide, polyhexamethylene sebacamide and polycaprolactam; acrylic resins, such as polymethylmethacrylate, polyacrylonitrile, polymethylacrylate, polyethylmethacrylate and styrene-methymethacrylate or ethylene-methyl acrylate copolymers, ethylene-ethyl acrylate copolymers, ethylene-ethyl methacrylate copolymers, polystyrene and copolymers of styrene with unsaturated acrylic monomers of the type mentioned hereinbefore, cellulose derivatives, such as cellulose acetate, cellulose acetate butyrate, cellulose propionate, cellulose acetate propionate, and ethyl cellulose; polyvinyl resins such as polyvinyl chloride, copolymers of vinyl chloride and vinyl acetate and polyvinyl butyral, polyvinyl alcohol, polyvinyl acetal, ethylene-vinyl acetate copolymers, and ethylene-allyl copolymers such as ethylene-allyl alcohol copolymers, ethylene-allyl acetone copolymers, ethylene-allyl benzene copolymers ethylene-allyl ether copolymers, ethylene-acrylic copolymers and polyoxymethylene, polycondensation polymers, such as, polyesters, polyurethanes, polyamides and polycarbonates. The layer-forming polymers used on the supports for the transparent elements fused in the method of this invention and the supports are each well known to those skilled in the art, as are methods for forming the coated supports. Suitable materials are film-forming polymers and include those described in U.S. Pat. No. 4,968,578, issued Nov. 6, 1990, which is hereby incorporated by reference herein. The polymers described in that patent for forming polymer surface layers on supports are film-forming addition or condensation polymers, which can be used as blends to provide the most desirable polymer surfaces. The preferred condensation polymers described in the aforementioned patent have average molecular weights in the range of about 20,000 to 80,000 while the preferred addition polymers have average molecular weights in the range of about 50,000 to 500,000. Specific classes of film-forming polymers described in U.S. Pat. No. 4,968,578 are polyesters, polystyrenes, polystyrene-acrylic, polymethyl methacryclate, polyvinyl acetate, polyolefins and copolymers such as poly(vinylethylene-co-acetate), polyethylene-co-acrylics, amorphous polypropylene and copolymers and graft copolymers of polypropylene. Particularly useful film-forming polymers are polyesters such as a copolyester of 50 mole percent terephthalic acid, 50 mole percent neopentyl glycol and 50 mole percent diethylene glycol, a copolyester of 50 mole percent terephthalic acid, 90 mole percent neopentyl glycol and 10 mole percent diethylene glycol and mixtures of these copolyesters.

Fusible toner particles used in this invention can have fusing temperatures of less than about 200° C., often less than about 100° C. so they can readily be fused to the transparent supports in the method of this invention and which have the capability of being fused to paper sheets, even resin coated paper sheets without deformation (blistering) of the resin coating to form the textured finish found to be desirable in copies viewed by reflection. Of course, if the toner images are fused to supports which can withstand higher temperatures, toner particles of higher fusing temperatures can be used.

Numerous colorant materials selected from dyestuffs or pigments can be employed in the toner particles used in the invention. Such materials serve to color the toner and/or render it more visible. The colorants can, in principle, be selected from virtually any of the compounds mentioned in the Colour Index Volumes 1 and 2, Second Edition. Included among the vast number of useful colorants are those dyes and/or pigments that are typically employed as blue, green, red and yellow colorants used in electrostatographic toners to make color copies. Suitable colorants also include those typically employed in primary substrative cyan, magenta and yellow colored toners. Examples of useful colorants are Hansa Yellow G (C.I. 11680) CI Yellow 12, CI Solvent Yellow 16, CI Disperse Yellow 33, Fuchsine N (C.I. 42510) C.I. Pigment Red 22, C.I. Solvent Red 19, C.I. Basic Blue 9 (C.I. 52015) and Pigment Blue 15. The amount of colorant added may vary over a wide range, for example, from about 1 to 20 percent of the weight of binder polymer used in the toner particles. Good results are obtained when the amount is from about 1 to 10 percent.

To utilize a binder polymer in an electrostatographic toner used in the practice of this invention, the polymer particles are mixed in any convenient manner with any other desired addenda, to form a free-flowing powder of toner particles containing the binder polymer. Useful toner particles can simply comprise the binder polymer and colorant but, it is often desirable to incorporate addenda such as waxes, release agents, change control agents, and other toner addenda well known in the art.

Charge control agents suitable for use in toners are disclosed for example in U.S. Pat. Nos. 3,893,935; 4,079,014; 4,323,634 and British Patent Nos. 1,501,065 and 1,420,839. Charge control agents are generally employed in small quantifies such as, about 0.1 to 3, weight percent, often about 0.2 to 1.5 weight percent, based on the weight of toner.

Toner images fused according to this invention can be formed from electrostatographic developers comprising toner particles that are mixed with a carrier vehicle. Carrier vehicles which can be used to form suitable developer compositions, can be selected from a variety of materials. Such materials include carrier core particles and core particles overcoated with a thin layer of film-forming resin. Examples of suitable resins are described in U.S. Pat. Nos. 3,547,822; 3,632,512; 3,795,618; 3,898,170; 4,545,060; 4,478,925; 4,076,857; and 3,970,571.

The carrier core particles can comprise conductive, non-conductive, magnetic, or non-magnetic materials. See, for example, U.S. Pat. Nos. 3,850,663 and 3,970,571. Especially useful in magnetic brush development schemes are iron particles such as porous iron particles having oxidized surfaces, steel particles, and other "hard" or "soft" ferromagnetic materials such as gamma ferric oxides or ferrites, such as ferrites of barium, strontium, lead, magnesium, or aluminum. See for example, U.S. Pat. Nos. 4,042,518; 4,478,925; and 4,546,060.

A typical developer composition containing toner particles and carrier vehicle generally comprises about 1 to 20 percent, by weight, of particulate toner particles and from 80 to 99 percent, by weight, carrier particles. Usually, the carrier particles are larger than the toner particles. Conventional carrier particles have a particle size on the order of about 20 to 1200 micrometers, generally about 30 to 300 micrometers. Alternatively, the toners can be used in a single component developer, i.e., with no carrier particles.

The toner and developer compositions described in the previous paragraphs can be used in a variety of ways to develop electrostatic charge patterns to provide the electrostatographic toner images fused by the method of this invention. Such developable charge patterns can be prepared by a number of means and be carried for example, on a light sensitive photoconductive element or a non-light-sensitive dielectric-surfaced element such as an insulator-coated conductive sheet. One suitable development technique involves cascading the developer composition across the electrostatic charge pattern, while another technique involves applying toner particles from a magnetic brush. This latter technique involves the use of a magnetically attractable carrier vehicle in forming the developer composition. After image-wise deposition of the toner particles to form an electrostatographic toner image, the image can be fixed or fused by the method of this invention to the support carrying the image which in this case, is a transparent support comprising a polymer layer. If desired, the unfused toner image can be transferred to a transparent support and then fused to form a permanent colored toner image thereon.

Typical toner particles generally have an average particle size in the range of about 0.1 to 100 micrometers, a size of about 8 to 15 micrometers being particularly useful in the practice of this invention to form high resolution images.

In the method of this invention the toner image is brought into pressure contact with the surface of the textured fusing member in the fusing zone. The temperature and pressure applied to fuse the toner particles causes the particles and the polymer layer bearing such particles to flow and take on the textured pattern of the fusing member and also form a low-level luster toner image having high color clarity. The textured pattern provides a low-level luster finish on the transparency in both the image and non-image areas. The specular reflectivity of such fused toner image is typically no more than about 10, often 5–10 as measured by a specular glossometer at 20°. The toner image somewhat irregular surface which provides the subdued luster which has been found to be pleasing upon viewing the image, particularly upon reflection viewing of a copy print, but is not sufficient to deleteriously effect the color clarity of a colored toner image. Thus, by substituting an opaque support such as paper for the transparent support used in the method of this invention, it is possible to obtain a copy print having a low luster finish that has been found to be pleasing in many instances, e.g. in multicolor continuous tone images. This result can be achieved without expensive and time consuming equipment modifications by simply changing support materials.

Fusing members that are employed in the practice of this invention have surface textures or roughnesses that are capable of providing low-luster fused toner images and can be obtained by conventional methods well-known to those skilled in the art. Fusing members having a defined texture or roughness and their use in fusing toner images are described, for example, in U.S. Pat. No. 4,258,095, issued Mar. 24, 1981, while U.S. Pat. No. 3,557,874, issued Jan. 19, 1971 and U.S. Pat. No. 3,539,671, issued Nov. 10, 1970, describe methods for providing metal articles such as rolls having controlled roughnesses.

As previously indicated herein, the low-luster fused toner image typically exhibits a specular reflectivity of no more than about 10, as measured by a specular glossmeter at 20°. Accordingly, the specular reflectivity referred to herein is reported in terms of gloss. Such gloss is readily perceptible to the unaided eye but it can be conveniently measured on the surface of the fused toner image using any suitable technique, for example, the method described in ASTM-D523-63. One technique utilizes a single reflectivity measurement, preferably one related to specular reflection, as of a type which measures the amount of light from a standard source which is specularly reflected in a defined path. A suitable device for this purpose is a Glossgard II 20° glossmeter (available commercially from Pacific Scientific Inc., Silver Springs, Md.) which produces a reading, on a standardized scale, of a specularly reflected ray of light having angles of incidence and reflection of 20° to the normal. The standard scale of such meter has a range from 0 to 100, the instrument being normally calibrated or adjusted so that the upper limit corresponds to a surface that has substantially less than the complete specular reflection of a true mirror. Specular reflectivity readings are reported as gloss numbers.

The use of a fusing member having the textured surface described herein, in the method of this invention, provides both fused toner images having a pleasing level of gloss and colored toner images, which images exhibit exceptional color clarity. Such clarity can be measured by means well known to those skilled in the art. As known to those skilled in the art, color clarity can be defined as the ratio of specular to total transmitted light expressed in percent. Such color clarity can be conveniently determined by placing an image on a transparent support in an optical light path and separately measuring or reading the specular and totally transmitted light with a suitable device, e.g., a Photometer. Typical temperatures used in the fusing zone where the fusing member contacts the toner image are in the range of about 100° to 140° C., often 105° C. to 135° C. and preferably 115° C. to 130° C. The pressure used in the method of this invention in combination with the aforementioned fusing temperature when the transparent support bearing the unfused colored toner particles initially contacts the fusing member include those conventionally employed in contact fusing processes in the prior art. They are generally in the range of about 3 $kg/cm^2$ to 15 $kg/cm^2$ and often about 10 $kg/cm^2$. As indicated in FIGS. 1 and 2, such pressure is conveniently applied using a roll, although any suitable pressure means known to those skilled in the art can be used.

The fusing member employed in the practice of this invention can be in any physical form suitable for applying heat in face-to-face relationship with the unfused toner image and maintaining such relationship through the cooling zone. Examples are the continuous belt 4 indicated in FIG. 1 or the roll 10 indicated in FIG. 2, although the fusing member could also be in the form of a plate. A continuous belt is preferred because this provides a straight, flat fusing path which reduces curl problems that can be introduced by a roll. When a continuous belt is employed, the belt must be reasonably flexible and also heat resistant; it is preferably made with a material such as stainless steel or polyester which meet such criteria. The outer surface of the fusing member which contacts the toner image can comprise a wide variety of materials known in the prior art to be suitable for use in such fusing surfaces, including aluminum, steel, various alloys as well as polymeric materials such as thermoset resins. Fusing members with fluoroelastomer surfaces can improve the release characteristics of the fuser member. Also release agents, for example, polymeric release oils such as polydiorganosiloxane release oils can be used. However, such additional release agents are frequently unnecessary in the practice of this invention because the toner image and polymer layer on the support are cooled in the cooling zone to a level where they readily release from the fusing member without toner image or polymer offset i.e. there is no transfer of toner image or polymer to the surface of the fusing member. The toner image to be fused normally moves through the fusing zone at a velocity of at least about 2.5 cm/sec., typically about 2.5 to 10 cm/sec. The velocity is generally kept constant as the element bearing the toner image moves through the cooling and release zones.

In the cooling zone, cooling of the fused toner image and polymer layer on the support is controlled so that they can be released from the fusing member at a temperature where no offset occurs. The temperature of the fused image and polymer layer are generally reduced at least about 40° C. often about 65° to 90° C. in the cooling zone. As previously indicated herein, cooling can be conveniently controlled simply by adjusting the velocity of the fusing member, for example, the velocity of a continuous belt or roll while air is impinged upon the belt, or upon the element, as in FIG. 2, although other cooling means such as a chill roll or plate could be used in place of air impingement. When a continuous belt is used as the fusing member, it usually is not necessary to press the element against the fusing member to maintain contact between the fusing member and the toner image because the toner image and polymer layer are heated in the fusing zone to a point where their surfaces act as an adhesive which temporarily bonds to the fusing member as the element moves through the cooling zone.

In the release zone the fused toner image is separated from the fusing member. Such release is not effected until the fusing member is cooled to a temperature where no toner image or polymer offset occurs. Such temperature is typically no more than about 75° C. and is normally in the range of about 30° to 60° C. The specific temperature used to achieve such separation will vary considerably as it depends upon the specific viscoelastic properties of the toner image and the polymer layer bearing such image. The release temperature chosen is one at which the toner image and polymer layer exhibit elastic flow characteristics and adhere to the support and exhibit sufficient cohesiveness so they will not offset onto the fuser member at the particular temperature used.

The elements fused in the method of this invention comprises a transparent support. A wide variety of such supports are known and commonly employed in the electrostatographic art. They include, for example, those supports used in the manufacture of photographic films including cellulose esters such as cellulose triacetate, cellulose acetate propionate or cellulose acetate butyrate, polyesters such as poly(ethylene terephthalate), polyamides, polycarbonates, polyimides, polyolefins, poly(vinyl acetals), polyesthers and poly sulfonamides. Polyester film supports, and especially poly(ethylene terephthalate) are preferred because of their excellent dimensional stability characteristics. When such a polyester is used as the support material, a subbing layer is advantageously employed to improve the bonding of the polymer layer bearing the toner image to the support. Useful subbing compositions for this purpose are well known in the photographic art and include, for example, polymers of vinylidene chloride such as vinylidene chloride/acrylonitrile/acrylic acid terpolymers or vinylidene chloride/methyl acrylate/itaconic acid terpolymers.

The following preparation and fusing techniques and examples are presented to further illustrate this invention.

In some of the preparations and examples polymer names contain an indication of the molar or weight ratios of the various units in the polymer, as specified. In some of the preparations and examples (as indicated therein), the relative concentrations of units are expressed as ratios or amounts of the monomers used to prepare the polymer.

DEVELOPER FORMULATION, IMAGING AND FUSING

Toner particles employed to form the toner images in the following examples were formulated from 100 parts binder polymer, 0–20 parts colorant, 0–20 parts addenda and 0–2 parts of charge agent per 100 parts binder polymer. The mixtures Were melt-compounded at temperatures in the range of 110° to 150° C. on a 2-roll rubber mill, the mass cooled to room temperature, and coarse ground and fluid energy-milled to produce toner particles having a particle size in the range of about 8 to 15 micrometers.

The toner particles were then mixed with carrier particles in a closed container on a 2-roll mill for 30 seconds to form a triboelectrically-charged 2-component dry electrostatographic developer comprising about 13 weight percent toner particles. The carrier particles employed were strontium ferrite particles coated with a thin poly(vinylidene fluoride) film.

The electrostatographic developer was used to develop a toner image on transparent poly(ethylene terephthalate) film 76 micrometers thick, subbed with a terpolymer of acrylonitrile, vinylidene chloride and acrylic acid, and coated with a layer 10 micrometers thick of a polyester blend, (60/40, wgt percent, having a Tg of 50° C. and a weight average molecular weight of about 30,000 of a condensation polymer of 50 mole percent terephthalic acid reacted with a 50/50 mole percent mixture of neopentyl glycol and diethylene glycol, and 50 mole percent of terephthalic acid reacted with a 90/10 mole percent mixture of neopentyl glycol and diethylene glycol. The blend had a loss tangent of 2.1 determined for a storage modulus, G', of $10^5$ dynes/cm$^2$ (G' of $1.15\times10^2$ dynes/cm$^2$, G'' of $4.86\times10^3$ dynes/cm$^2$ and a melt viscosity of $4.86\times10^3$ poise measured at a temperature of 150° and 1 rad/sec.) all measured using a Rheometric Model RDA 700 rheometer (commercially available from Rheometric Inc., Piscataway, N.J.) using parallel plates in a sinusoidal shear mode.

Biased development was carried out in an electrophotographic copying apparatus having an organic photoconductor film, a magnetic brush developing station and a biased roll transfer station for transferring the toner image from the photoconductor film to the poly(ethylene terephthalate) film support. The toner image comprised a half-tone screen toner image developed with toner particles having a loss tangent of 1.6.

The toner image was fused using a fusing device of the type illustrated in FIG. 1 in which the fusing member was a continuous textured steel belt having an average roughness, Ra (reported as root mean square, measure of peaks and valleys, in micrometers) of 0.1, a peak height of 1.0 micrometers and a peak frequency of 600 peaks/cm which provided a surface gloss on the fused toner image of 5.5. The gloss was determined using a Glossgard II glossmeter (commercially available from Pacific Scientific Inc., Silver Springs, Md.) at an angle of 20°. The average gloss for 5 readings is reported. The fusing conditions used were as follows:

| | |
|---|---|
| Belt Velocity | 6.5 cm/sec. |
| Fusing Temperature | 105°–130° C. |
| Pressure | 3–15 kg/cm$^2$ |
| Nip Width | 0.4–0.6 cm |
| Cooling Air Temperature | 20°–25° |

-continued

| | |
|---|---|
| Release Temperature at Roll | 40°-65° C. |

EXAMPLE 1

The fusing method of this invention is effective to provide a projection viewable transparency having excellent color clarity combined with a low level of gloss in image areas. To illustrate, a developer composition comprising the following toner was prepared as described previously in the Developer Formulation, Imaging and Fusing section.

Toner particles were formulated from 100 parts of a binder polymer comprising a branched polyester of terephthalic acid, glutaric acid, propanediol and glycerol (87/13/95/5 molar ratios) having an inherent viscosity of 0.4 dl/g in dichloromethane, a $T_g$ of 62° C., a weight average molecular weight of 70,000 and a $M_n$ of 10,000, 6 parts of a cyan colorant and 1 part of a quaternary ammonium charge agent. The pulverized toner particles were classified to provide cyan toner particles having a loss tangent of 2.1 determined for a storage modulus, G', of 105 dynes/cm$^2$ (G' of $2.01\times10^3$ dynes/cm$^2$, G'' of $1.05\times10^4$ dynes/cm$^2$ and a melt viscosity of $1.07\times10^4$ poise measured at a temperature of 150° and 1 rad/sec.) all measured using a Rheometrics Model RDA 700 rheometer (commercially available from Rheometrics, Inc., Piscataway, N.J.) using parallel plates in a sinusoidal shear mode. This toner was used to develop the half-tone screen image, as described in the Developer Formulation, Imaging and Fusing section.

The gloss of the toner image was determined using a MICRO TRI glossmeter (commercially available from Byk Gardner, Inc. Silver Springs, Md.) at an angle of 20°. The gloss was 7, which is the average gloss for 5readings on the half-tone screen image.

Upon projection in an overhead projector the cyan half-tone screen image showed high color density and saturation comparable to that of the original image. The color clarity for the image, determined as described previously herein was approximately 75 percent. By comparison, the same image developed and fused on the poly(ethylene terephthalate) transparent support but without the layer formed from the polyester blend, had a clarity of only 60 percent.

EXAMPLE 2

The procedure of Example 1 was repeated except that the following toner was substituted for the toner used in that example.

Toner particles were formulated from 100 parts of a binder polymer comprising poly(styrene-co-n-butylacrylate)[80/20 weight percent] having a $T_g$ of 68° C., a weight-average molecular weight ($\overline{M}_n$) of 47,000, a number-average molecular weight ($\overline{M}_n$) of 23,000, and 8 parts of a blue colorant. The pulverized toner particles were classified to provide blue toner particles having a particle size of 7-9 micrometers and a loss tangent of 2.6 determined for a storage modulus, G', of $10^5$ dynes/cm$^2$ (G' of $5.84\times10^1$ dynes/cm$^2$, G'' of $1.86\times10^3$ dynes/cm$^2$ and melt viscosity of $1.86\times10^3$ poise measured at a temperature of 150° and 1 rad/sec.) measured as described in Example 1. This toner was used to develop the half-tone screen image, as described in Example 1. The clarity of the fused toner image was 78 percent, while its gloss was 8, both determined as in Example 1.

EXAMPLE 3

The procedure of Example 1 was repeated except that the polyester blend coated on the poly(ethylene therphthalate film was replaced with a coating of poly(styrene-co-n-butyl acrylate) [70/30 weight percent] having a Tg of 52° C., a $\overline{M}_w$ of 100,000, a number average molecular weight of 30,000, and a loss tangent of 1.7 determined for a storage modulus, G'', of $10^5$ dynes/cm$^2$ (G' of $1.05\times10^3$, G'' of $7.54\times10^3$ and melt viscosity of $7.61\times10^3$ poise measured at a temperature of 150° and 1 rad/sec.), measured as described in Example 1. The clarity of the cyan half-tone screen image was 70 percent, while the gloss was 5, each measured as described in Example 1.

Toner particles prepared according to the procedure of this Example from the following high loss tangent binder polymers provide similar levels of clarity and gloss;

(1) Poly(styrene-co-n-butylacrylate) [80/20 weight percent] having a $T_g$ of 68° C., a weight-average molecular weight of 23,000, a number-average molecular weight ($\overline{M}_n$) of 12,000 and a loss tangent of 3.2 determined for a storage modulus, G', of 10 dynes/cm$^2$ (G of $2.46\times10^{\circ}$ dynes/cm$^2$, G'' of $4.651\times10^2$ dynes/cm$^2$ and melt viscosity of $4.651\times10^2$ poise measured at a temperature of 150° C. and 1 rad/sec.) measured as described in Example 1.

(2) Polystyrene having a Tg of 59° C., a weight-average molecular weight ($\overline{M}_w$) of 9,000, a number-average molecular weight ($\overline{M}_n$) of 2,500 and a loss tangent of 5.4 determined for a storage modulus, G', of 10 dynes/cm$^2$ (G'' of $4.061\times10$ dynes/cm$^2$, G'' of $3.356\times10^1$ dynes/cm$^2$ and melt viscosity of $3.381\times10^1$ poise measured at a temperature of 150° C. and 1 rad/sec.) measured as described in Example 1.

(3) Polystyrene having a $T_g$ of 68° C., a weight-average molecular weight ($\overline{M}_w$) of 4,400 a number-average molecular weight ($\overline{M}_n$) of 1,700 and a loss tangent of 8.0 determined for a storage modulus, G', of $10^5$ dynes/cm$^2$ (G of $8.6\times10^{-1}$ dynes/cm$^2$, G'' of $2.71\times10^2$ dynes/cm$^2$ and melt viscosity of $2.71\times10^2$ poise measured at a temperature of 150° C. and 1 rad/sec.) measured as described in Example 1.

It is evident from the foregoing specification, and particularly the Examples, that the fusing method of this invention makes it possible to obtain transparencies comprising toner images of very high color clarity combined with a low level of gloss. Such color transparencies faithfully reproduce the color of an original image and exhibits excellent color saturation.

The invention has been described in detail with particular reference to certain preferred embodiments thereof, but it should be appreciated that variations in modification can be effected within the spirit and scope of the invention.

We claim:

1. A fusing method for making a transparency capable of projecting an electrostatographic colored toner image that exhibits excellent color clarity, which method comprises:

a. providing an element having a transparent support comprising a polymer layer bearing an image in colored toner particles that exhibit a loss tangent (tan δ) of at least 1.6 upon fusing the image with heat and pressure, the polymer forming such layer also having a loss tangent (tan δ) of at least 1.6;

b. passing the element successively through a fusing zone, a cooling zone and a release zone;

c. within the fusing zone, bringing the image and polymer layer into pressure contact with a textured surface of a fusing member at a temperature that fuses the image to the support and causes the polymer layer to flow, the textured surface being capable of providing a low-luster fused toner image;

d. maintaining contact between the fused image and the fusing member within the cooling zone while reducing the temperature of the fusing member; and e. separating the fused image from the fusing member within the release zone at a temperature where the image and the polymer layer do not offset.

2. The method of claim 1, wherein the loss tangent for the toner image particles is in the range of about 1.6 to 5.5.

3. The method of claim 2, wherein the toner image is a blue toner image.

4. The method of claim 2, wherein the toner image is a cyan toner image.

5. The method of claim 1, wherein the toner image comprises a polyester binder.

6. The method of claim 1, wherein the toner image comprises a styrene-acrylic copolymer binder.

7. The method of claim 1, wherein the fusing member is a continuous web.

8. The method claim 7, wherein the textured surface of the fusing member is capable of providing the fused toner image with a specular reflectivity of no more than about 5 percent.

9. The method of claim 7, wherein the surface of the fusing member has an average roughness of 0.1, a peak height of 1.0 micrometers and a peak frequency of 600 peaks/cm.

10. The method of claim 4, wherein the fusing member is a continuous web.

11. The method of claim 10 wherein the temperature of the fusing member is less than about 140° C.

12. The method of claim 11, wherein the particle size of the toner particles is in the range of about 8 to 15 micrometers.

13. The method of claim 1, wherein the polymer forming the layer on the support is a polyester.

14. The method of claim 13, wherein the polyester is a copolyester of terephthalic acid with neopentyl glycol and diethylene glycol.

* * * * *